US007854341B2

(12) United States Patent
Martin

(10) Patent No.: US 7,854,341 B2
(45) Date of Patent: Dec. 21, 2010

(54) PAINT TRAY SYSTEM

(75) Inventor: Charles G. Martin, Hampton (CA)

(73) Assignee: T.S. Simms & Co. Limited, Saint John, New Brunswick (CA)

( * ) Notice: Subject to any disclaimer, the term of this patent is extended or adjusted under 35 U.S.C. 154(b) by 574 days.

(21) Appl. No.: 11/842,453

(22) Filed: Aug. 21, 2007

(65) Prior Publication Data

US 2009/0050632 A1 Feb. 26, 2009

(51) Int. Cl.
*B65D 1/24* (2006.01)
*B65D 6/28* (2006.01)

(52) U.S. Cl. ..... 220/23.86; 220/503; 220/4.27

(58) Field of Classification Search ..... None
See application file for complete search history.

(56) References Cited

U.S. PATENT DOCUMENTS 4,296,871 A * 10/1981 Andersson ..... 220/781
4,344,646 A * 8/1982 Michel ..... 292/87
4,445,250 A * 5/1984 Seidl ..... 15/257.06
4,541,542 A 9/1985 Florentino
4,735,337 A * 4/1988 Von Holdt ..... 220/276
4,895,256 A * 1/1990 Johnston ..... 206/501
5,123,565 A * 6/1992 Majewski ..... 220/701
5,269,438 A * 12/1993 Kelsey ..... 220/766
5,460,289 A * 10/1995 Gemmell ..... 220/495.02
5,533,228 A 7/1996 Jarecki et al.
5,553,701 A * 9/1996 Jarecki et al. ..... 206/15.2
5,568,879 A * 10/1996 Kovathana ..... 220/697
5,966,772 A * 10/1999 Woodnorth et al. ..... 15/230.11
6,196,410 B1 3/2001 Hocking
6,622,884 B1 9/2003 Gartner
2001/0025865 A1 * 10/2001 Bravo et al. ..... 222/465.1
2004/0238399 A1 12/2004 Billado, Jr.
2005/0252920 A1 11/2005 Cumming et al.

* cited by examiner

*Primary Examiner*—Anthony Stashick
*Assistant Examiner*—Robert J Hicks

(57) ABSTRACT

A paint tray system has a paint tray with an upper circumferential land having an upwardly projecting dowel at each corner. A paint tray liner has a medial portion substantially conforming to an inside surface of the paint tray and a peripheral liner lip extending over the land. The liner lip has four corner holes receiving the four corner dowels. A paint tray lid has a peripheral lid lip extending over the land, the lid lip having four corner holes receiving the four corner dowels.

21 Claims, 5 Drawing Sheets

PAINT TRAY SYSTEM

BACKGROUND

This invention relates to a paint tray system, paint tray liner, and paint tray lid.

A painting job may be interrupted for a space of time, such as by the end of the day. In such instance, the painter will want to avoid paint drying out on painting implements and in containers.

U.S. Pat. No. 6,196,410 to Hocking addresses this problem for paint trays and roller coaters by providing a lid for the paint tray which lid is hinged to a paint tray liner to allow the open tray to by closed to delay drying of paint in the tray. The lid also accommodates the handle of a roller coater so that the roller of the roller coater can be left under the cover.

There remains a need for an improved paint tray system.

SUMMARY

In one aspect, a paint tray system is provided which has a paint tray with an upper circumferential land having an upwardly projecting dowel at each corner. A paint tray liner has a medial portion substantially conforming to an inside surface of the paint tray and a peripheral liner lip extending over the land. The liner lip has four corner holes receiving the four corner dowels. A paint tray lid has a peripheral lid lip extending over the land, the lid lip having four corner holes receiving the four corner dowels.

In accordance to the present invention, there is provided a paint tray system comprising: a paint tray having an upper circumferential land with an upwardly projecting dowel at each corner of said land; a paint tray liner having a medial portion substantially conforming to an inside surface of said paint tray and a peripheral liner lip extending over said land, said liner lip having four corner holes receiving said four corner dowels; a paint tray lid having a peripheral lid lip extending over said land, said lid lip having four corner holes receiving said four corner dowels.

In accordance to another aspect of the present invention, there is provided a paint tray liner comprising: a pair of opposed side walls and a pair of opposed end walls defining a generally rectangular outline and a floor, said floor having a sloping floor portion extending from a sloping floor upper end at a first end wall of said liner to a sloping floor lower end terminating in a paint well extending from an opposite second end wall of said liner; a peripheral liner lip extending from a top edge of said side walls and said end walls, said liner lip having a hole at each of the four corners made by said end walls and side walls.

In accordance to a further aspect of the invention, there is provided a paint tray lid comprising: a peripheral lid lip, said lid lip having four corner holes; and a bulge extending inwardly from an end of said lid.

Other features and advantages will become apparent from the following description in conjunction with the drawings.

BRIEF DESCRIPTION OF THE DRAWINGS

In the figures which illustrate example embodiments of the invention.

DETAILED DESCRIPTION

Figure 1:
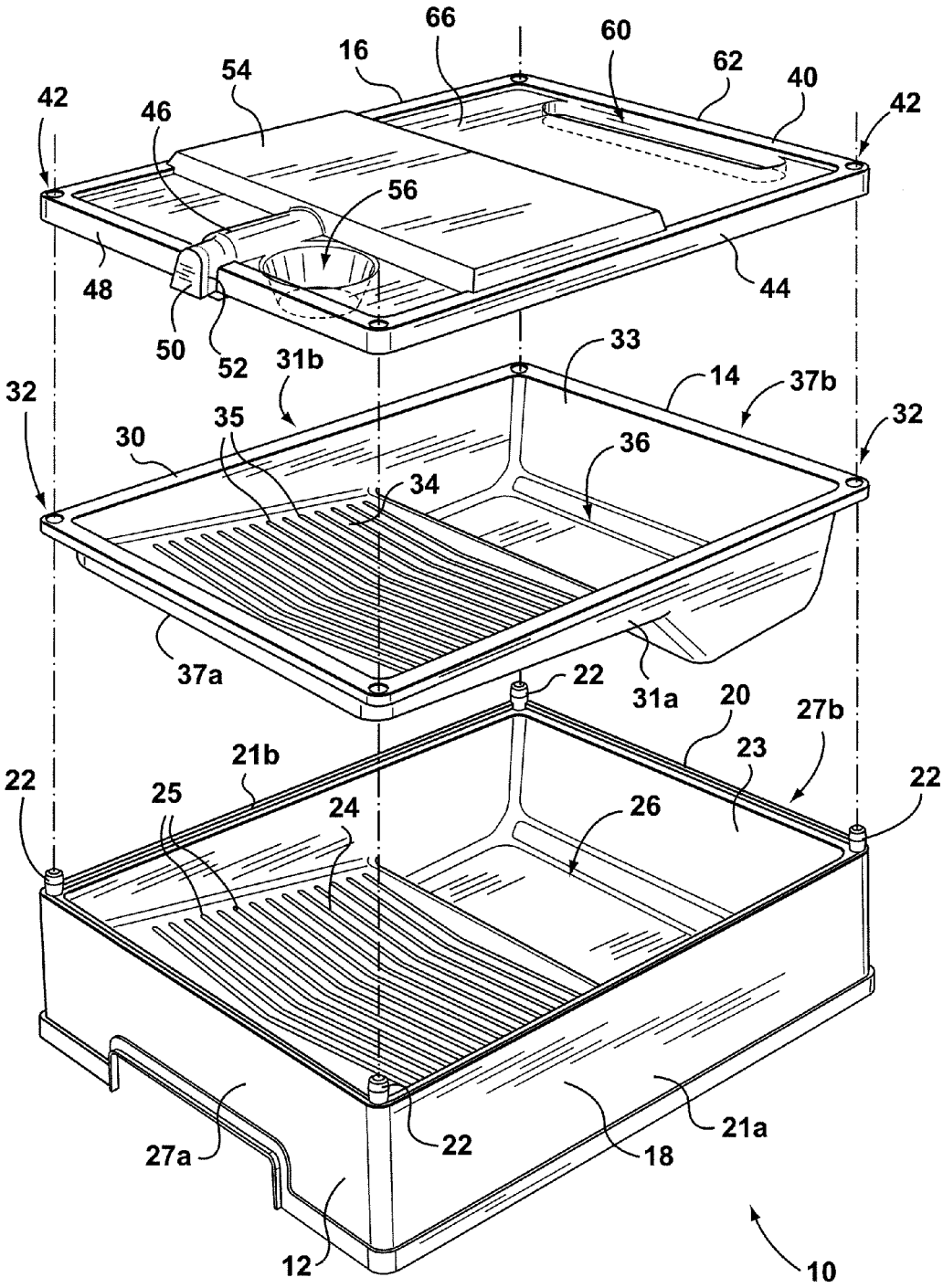
FIG. 1 is an exploded view of a paint tray system made in accordance with this invention.

With reference to FIG. 1, a paint tray system 10 comprises a paint tray 12, a paint tray liner 14, and a paint tray lid 16.

The tray 12 has a pair of opposed side walls 21*a*, 21*b* and a pair of end walls 27*a*, 27*b* defining a generally rectangular outline. The walls terminate in an upper circumferential, rectangular, land 20. Integrally formed dowel pins 22 project upwardly from each corner of the land. The inside surface 23 of the tray has a sloping floor portion 24 with an upper end extending from tray end wall 27*a* and a lower end terminating at a paint well 26. The sloping floor portion has ribs 25.

The liner 14 has a pair of opposed side walls 31*a*, 31*b* and a pair of opposed end walls 37*a*, 37*b* defining a generally rectangular outline. A medial portion 33 of the liner substantially conforms to the inside surface 23 of the tray. Thus, the medial section has a sloping floor portion 34 (with ribs 35) terminating at a paint well 36. The liner has a peripheral liner lip 30 which, when the liner is in place on the tray, extends over the land 20 of the tray. The liner lip has four corner holes 32 for receiving the four corner dowels of the tray 12. These holes 32 may have a smaller diameter than that of the dowels 22.

The lid 16 also has a rectangular outline. The lid has a peripheral lip 40 which, when the lid is in place on the tray, extends over the land 20 of the tray. The lip 40 has four corner holes 42 for receiving the four corner dowels of the tray 12. These holes 42 may have a smaller diameter than that of the dowels 22. Lip 40 has a depending skirt 44 which enhances the strength and rigidity of the lid. The lid has a bulge 46 extending inwardly from an end 48 of the lid which is at the upper end of the sloped floor portion 24 of the paint tray. The bulge also projects slightly beyond the reminder of end 48 of the lid, terminating in a blind outside end 50. Optionally, a line of weakness 52 may be provided proximate the blind end 50 to facilitate removal of the blind end. The inner end of the bulge terminates at a raised section 54 of the lid. The raised section extends from this inner end of the bulge to a point of the lid which, when the lid is in place on the tray, is approximately over the lower end of the tray's sloping floor 24, i.e., the point where the sloping floor terminates at the well 26. A cup-like depression 56 is provided in the lid proximate lid end 48 and adjacent bulge 46.

A channel-like depression 60 parallels an end 62 of the lid, which end is opposite end 48.

The medial area 66 of the lid spaced from the bulge 46, cup 56, channel 60, and raised section 54 is depressed with respect to lip 40 forming an inner step 41 from the medial area 66 up to the lip 40. In consequence, the lip is raised above the medial section of the lid other than at the bulge and raised section.

The lid may be fabricated of a clear plastic material.

Figure 2:
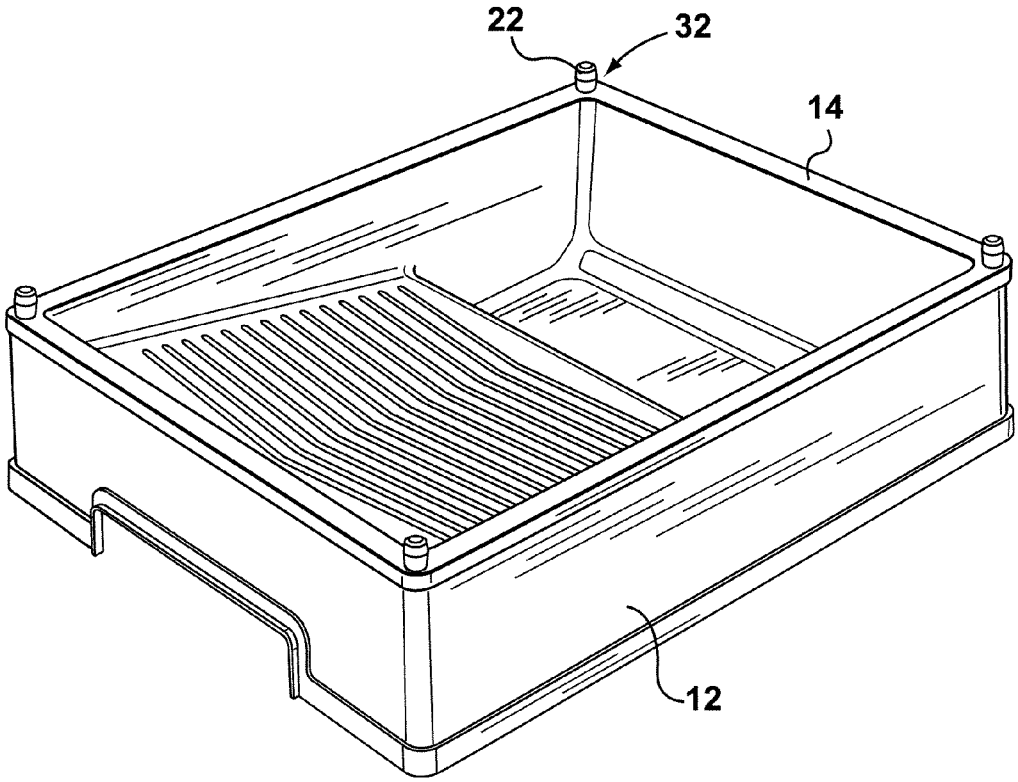
FIG. 2 is an assembled perspective view of the paint tray and liner of FIG. 1.

To assemble the paint tray system, as shown in FIG. 2, the liner 14 may be set into the tray 12 with the four corner holes 32 of the liner received by the four corner dowels 22 of the tray. With the holes being smaller in diameter than the dowels, this will be a press fit which will assist in maintaining the liner in place.

Figure 3:
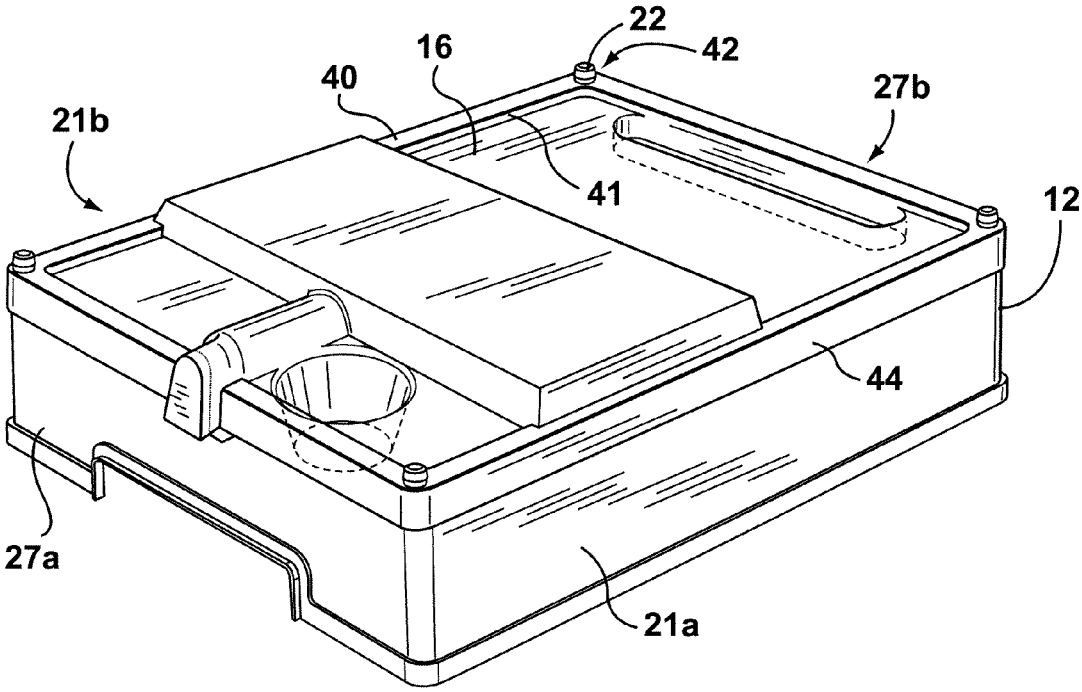
FIG. 3 is an assembled perspective view of the paint tray system of FIG. 1.

Turning to FIG. 3, next the lid 16 may be placed on the tray with the bulge 46 proximate tray end 27*a* and with its four corner holes 42 registered with dowels 22 and pressed over the dowels. Because the lip of the lid is raised with respect to the medial area 66 of the lid, sections of the upper edge of the side walls 21*a*, 21*b* and the end walls 27*a*, 27*b* of the tray are enveloped by the ridge 41, lip 40, and skirt 44 of the lid. This, along with the reception of the holes 42 of the lid by the dowels 22 securely locates the lid on the tray.

Figure 4:
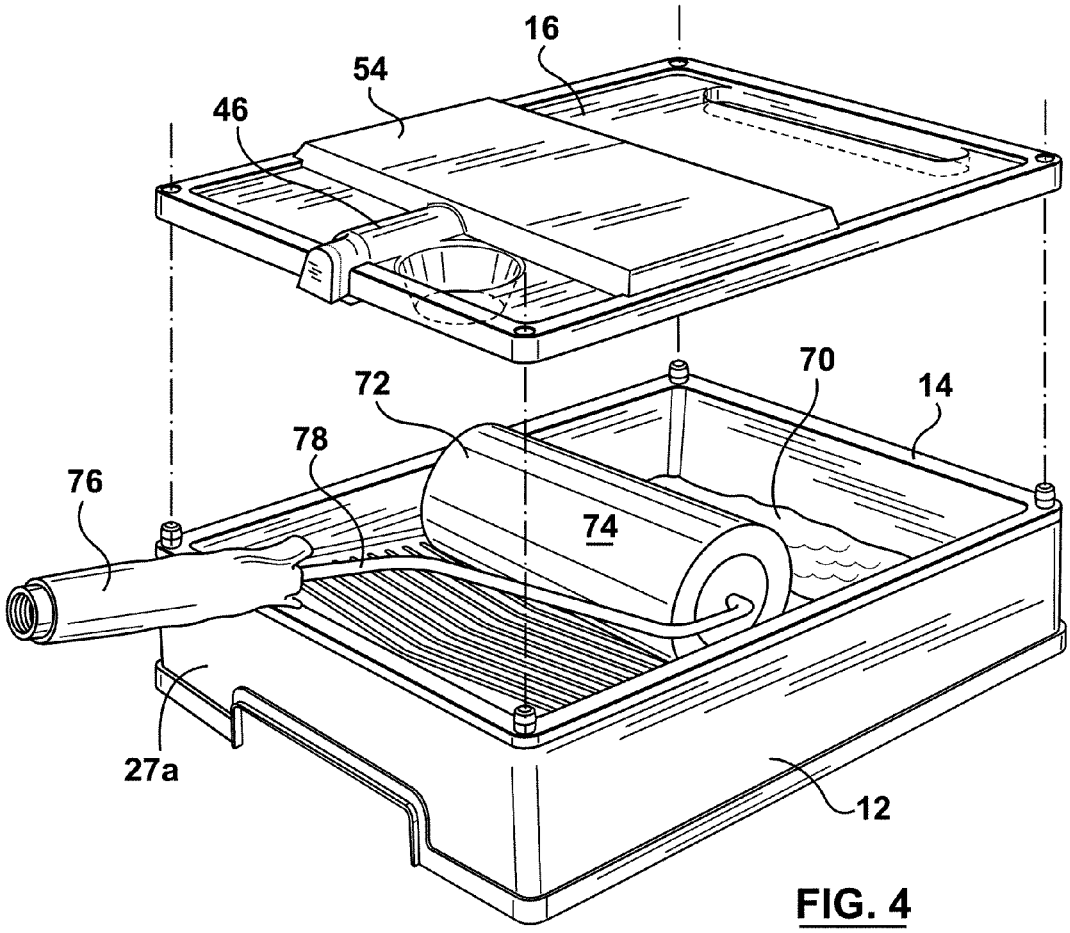
FIG. 4 is a partially exploded view of the paint tray system of FIG. 1 shown in use.
Figure 5:
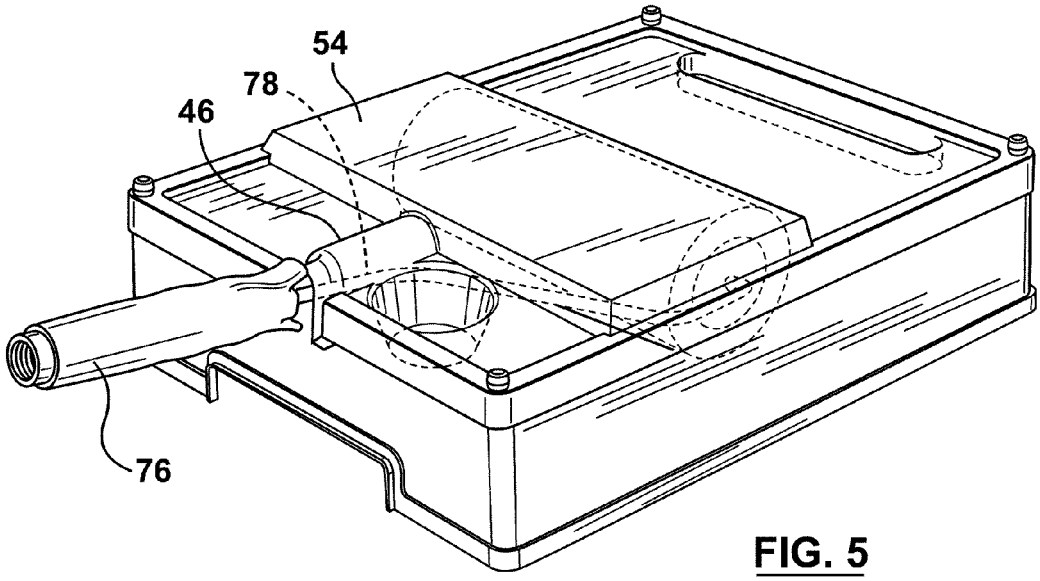
FIG. 5 is an assembled perspective view of the paint tray system of FIG. 1 shown in use.
Figure 6:
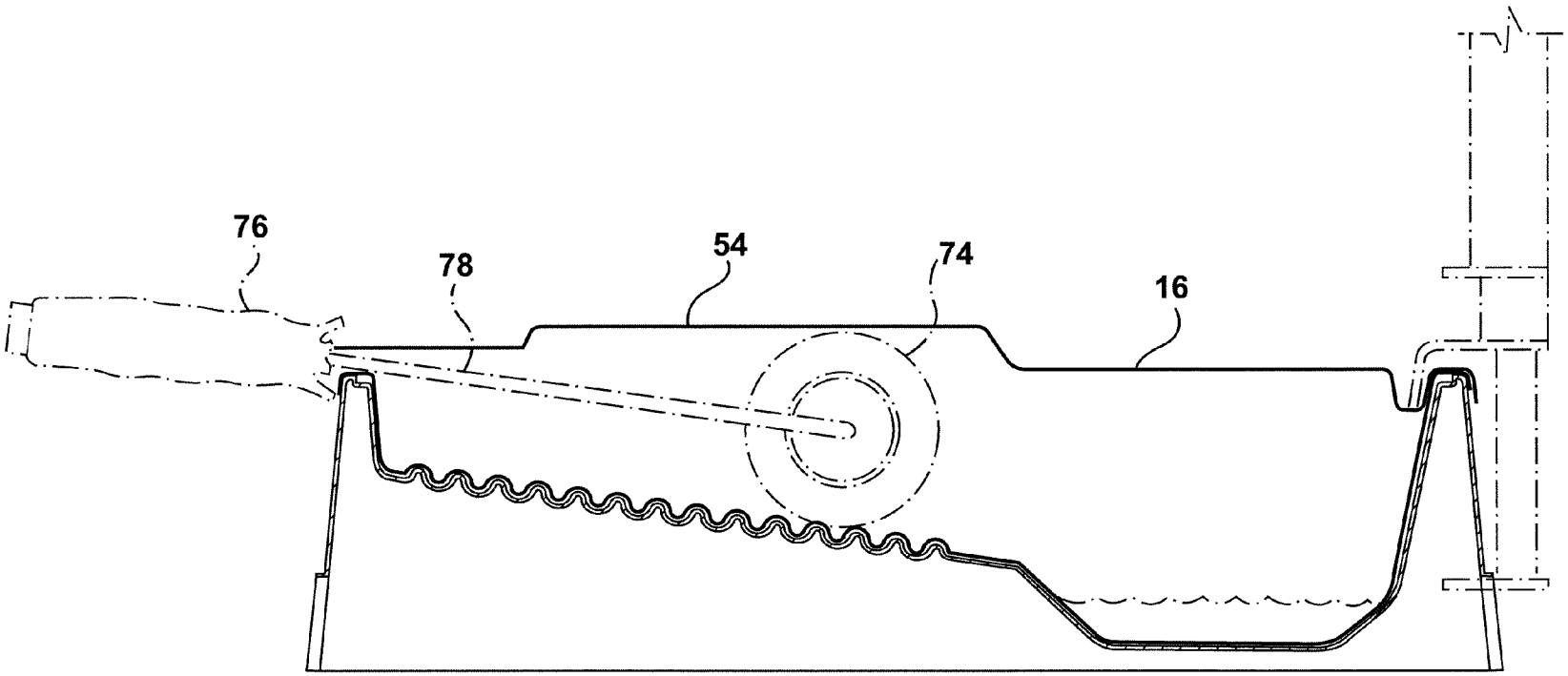
FIG. 6 is a medial cross-sectional view of the paint tray system of FIG. 1.

With reference to FIG. 4, in use, a paint tray liner 14 may be set into a paint tray 12 and then paint 70 poured into the well 36 of the liner. A standard roller coater 72 may then be loaded with paint from this well in conventional fashion and used to apply paint. If painting is interrupted, the roller coater 72 may be temporarily stored in the tray by placing it with its roller 74 resting on the ramped floor 34 of the liner 14 within tray 12 and its handle 76 extending medially between tray side walls 21*a*, 21*b* and projecting beyond end 27*a* of the tray. A lid 16, with the blind end 50 (FIG. 1) of bulge 46 removed, may then be attached to the tray such that the bulge 46 of the lid overlies the portion of the angulated rod 78 of the roller coater which extends from its handle. The roller 74 of the roller coater will be accommodated by the raised section 54 of the lid 16, as illustrated in FIGS. 5 and 6.

Figure 7:
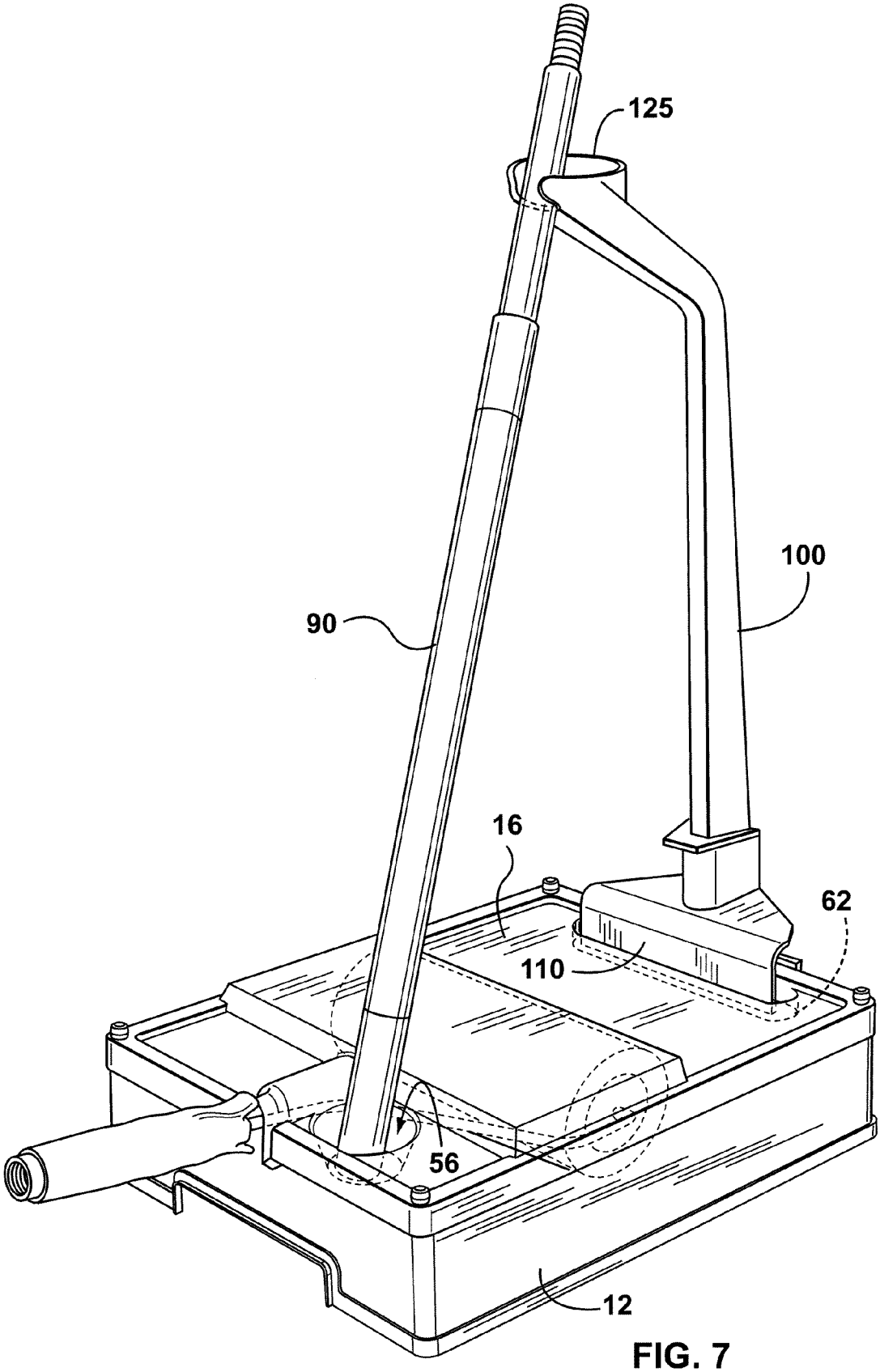
FIG. 7 is an assembled perspective view of the paint tray system of FIG. 1 shown in use.

Turning to FIG. 7, if the paint tray system 10 is used with a tray carrier 100 as described in U.S. patent application Ser. No. 11/419,094 filed May 18, 2006 and published as US2006/0261231 on Nov. 23, 2006, the contents of which are incorporated herein by reference, channel 60 accommodates the L-shaped clip 110 of the carrier 100. In consequence, the carrier 100 may be attached to the tray 12 with the lid 16 in place. Further, one end of a roller coater extension pole 90 may rest in the cup-like depression 56 of the lid while the pole may be supported proximate its other end by the receptor 125 at the upper end of the carrier 100. Consequently, the paint tray system 10 may be used to temporarily store an extension pole 90 for a roller coater 70 as well as the roller coater itself. And the lid, by allowing the support 100 to be connected to the tray system 10, allows the entire system 10 to be moved about.

The lid 16 will limit the air exposure of paint in well 26 and in a roller coater 70 stored by the paint tray system 10. Thus, the paint tray system will delay drying of this paint.

Modifications will be apparent to those skilled in the art and, therefore, the invention is defined in the claims.

What is claimed is:

1. A paint tray system comprising:

a paint tray having an upper circumferential land with an upwardly projecting dowel at each corner of said land;

a paint tray liner having a medial portion substantially conforming to an inside surface of said paint tray and a peripheral liner lip extending over said land, said liner lip having four corner holes receiving said four corner dowels;

a paint tray lid having a peripheral lid lip extending over said land, said lid lip having four corner holes receiving said four corner dowels.

2. The paint tray system of claim 1 wherein said inside surface of said paint tray has a sloping floor portion terminating at its lower end at a paint well.

3. The paint tray system of claim 2 wherein said lid has a bulge extending inwardly from an end of said lid which is at an upper end of said sloped floor portion of said paint tray.

4. The paint tray system of claim 3 wherein said lid lip terminates in a downwardly depending skirt.

5. The paint tray system of claim 4 wherein said bulge terminates in a blind at said end of said lid.

6. The paint tray system of claim 5 wherein said bulge has a line of weakness arranged to facilitate tear off of said blind.

7. The paint tray system of claim 1 wherein said lid defines a cup-shaped depression proximate said end of said lid.

8. The paint tray system of claim 7 wherein said end of said lid is a first lid end and said lid defines a linear channel paralleling a second lid end, said second lid end being opposite said first lid end.

9. The paint tray system of claim 6 wherein said lid has a raised section extending from an inner end of said bulge approximately to a portion of said lid overlying said lower end of said sloping floor portion of said paint tray.

10. The paint tray system of claim 9 wherein said lid lip is raised above medial portions of said lid other than at said bulge and said raised section.

11. The paint tray system of claim 10 wherein said lid is fabricated of a transparent plastic material.

12. A paint tray liner comprising:

a single-walled legless structure defining a pair of opposed side walls and a pair of opposed end walls defining a generally rectangular outline and a floor, said side walls having a lesser thickness proximate a first end wall of said liner enlarging to a greater thickness proximate a second end wall of said liner such that said floor has a sloping floor portion extending from a sloping floor upper end at said first end wall to a sloping floor lower end terminating in a paint well extending from said second end wall;

a peripheral liner lip extending from a top edge of said side walls and said end walls, said liner lip having a through hole at each of four corners made by said end walls and side walls.

13. The paint tray liner of claim 12 further comprising a depending peripheral skirt extending along an outside edge of said lip.

14. The paint tray liner of claim 13 wherein said sloping floor has a series of transverse ribs extending thereacross.

15. A paint tray lid comprising:

a peripheral lid lip, said lid lip having four corner holes; and a bulge extending inwardly from an end of said lid medially between opposed sides of said lid, said bulge sized to accommodate a portion of a roller coater between a handle of the roller coater and a roller of the roller coater;

said bulge terminating in a blind at an end of said lid, said bulge having a line of weakness arranged to facilitate tearing off of said blind.

16. The paint tray lid of claim 15 wherein said lid lip terminates in a downwardly depending skirt.

17. The paint tray lid of claim 15 wherein said lid defines a cup-shaped depression proximate said end of said lid.

18. The paint tray lid of claim 17 wherein said end of said lid is a first lid end and said lid defines a linear channel paralleling a second lid end, said second lid end being opposite said first lid end.

19. The paint tray lid of claim 15 wherein said lid has a raised section extending from an inner end of said bulge.

20. The paint tray lid of claim 18 wherein said lid lip is raised above medial portions of said lid other than at said bulge and said raised section.

21. The paint tray lid of claim 20 wherein said lid is fabricated of a transparent plastic material.

* * * * *